US006386918B1

(12) United States Patent
Zheng et al.

(10) Patent No.: US 6,386,918 B1
(45) Date of Patent: May 14, 2002

(54) RETENTION ELEMENT FOR ELECTRICAL CONNECTOR

(75) Inventors: Qi Sheng Zheng; Hong Bin Zhou; Ming Ge, all of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/760,359

(22) Filed: Jan. 12, 2001

(30) Foreign Application Priority Data

Nov. 28, 2000 (TW) ..... 89220647 U

(51) Int. Cl.[7] ..... H01R 13/648
(52) U.S. Cl. ..... 439/607; 439/345
(58) Field of Search ..... 439/607–610, 439/79, 564, 345

(56) References Cited

U.S. PATENT DOCUMENTS 6,086,421 A * 7/2000 Wu et al. ..... 439/607
6,099,327 A * 8/2000 Chen ..... 439/607
6,113,427 A * 9/2000 Wu ..... 439/607
6,168,466 B1 * 1/2001 Chien ..... 439/607
6,168,467 B1 * 1/2001 Chien ..... 439/607

* cited by examiner

*Primary Examiner*—Hien Vu
(74) *Attorney, Agent, or Firm*—Wei Te Chung

(57) ABSTRACT

An electrical connector (2) includes an insulative housing (20), a number of electrical terminals (21), a conductive shield (23) and a retention element (22). The insulative housing includes a base portion (24) defining a receiving cavity (200) and an island portion (25) extending through the receiving cavity to substantially divide the receiving cavity into a first portion (201) and a second portion (202). The retention element includes a retention portion (223) retained by the insulative housing, a transition portion (222) extending forwardly from the retention portion and a curved portion (221) extending upwardly and rearwardly from the transition portion to project into the second portion of the receiving cavity.

3 Claims, 6 Drawing Sheets

RETENTION ELEMENT FOR ELECTRICAL CONNECTOR

BACKGROUND OF THE INVENTION

1. Field of the Invention

The present invention relates to an electrical connector, and particularly to an electrical connector having a retention element for ensuring mating between the electrical connector and a complementary electrical connector.

2. Description of the Related Art

Many electrical connectors have retention elements for ensuring mating between the electrical connectors and complementary electrical connectors thereof. Referring to FIGS. 7 and 8, a conventional retention element 1 for ensuring mating between complementary electrical connectors (not shown) is generally U-shaped. The retention element 1 comprises a pair of parallel fixing portions 13, a central portion 12 perpendicularly connecting the fixing portions 13 and a curved portion 11 extending upwardly and rearwardly from an edge of the central portion 12. Each fixing portion 13 defines an opening 14 therein for engaging with a protrusion on an insulative housing (not shown) of the electrical connector. The structure of the retention element 1 is relatively complicated and undoubtedly increases the manufacturing cost of the electrical connector. The engagement between the opening and the protrusion is not reliable as can be desired, especially when the electrical connector is used in an environment where frequent plugging and unplugging is required. In such an environment, the retention element 1 would be apt to fall off and the engagement between the mated electrical connectors would not be ensured.

Therefore, an electrical connector having an improved retention element is desired to overcome the disadvantages of the prior art.

SUMMARY OF THE INVENTION

A major object of the present invention is to provide an electrical connector having a retention element which is compact in configuration and which is reliably retained to the electrical connector.

An electrical connector in accordance with the present invention comprises an insulative housing, a plurality of electrical terminals, a conductive shield and a retention element. The insulative housing comprises a base portion and an island portion extending forwardly from and substantially beyond the base portion. The base portion defines a receiving cavity for receiving a complementary electrical connector and a slit in a bottom thereof communicating with the receiving cavity. The island portion extends through the receiving cavity and defines a plurality of terminal receiving passageways in communication with the receiving cavity for receiving the electrical terminals therein. The retention element comprises a curved portion, a retention portion and a transition portion between the curved and retention portions. The retention portion is retained in the slit and the curved portion extends into the receiving cavity to retainably engage with an inserted complementary electrical connector in the receiving cavity.

Other objects, advantages and novel features of the invention will become more apparent from the following detailed description of the present embodiment when taken in conjunction with the accompanying drawings.

DETAILED DESCRIPTION OF THE INVENTION

Figure 1:
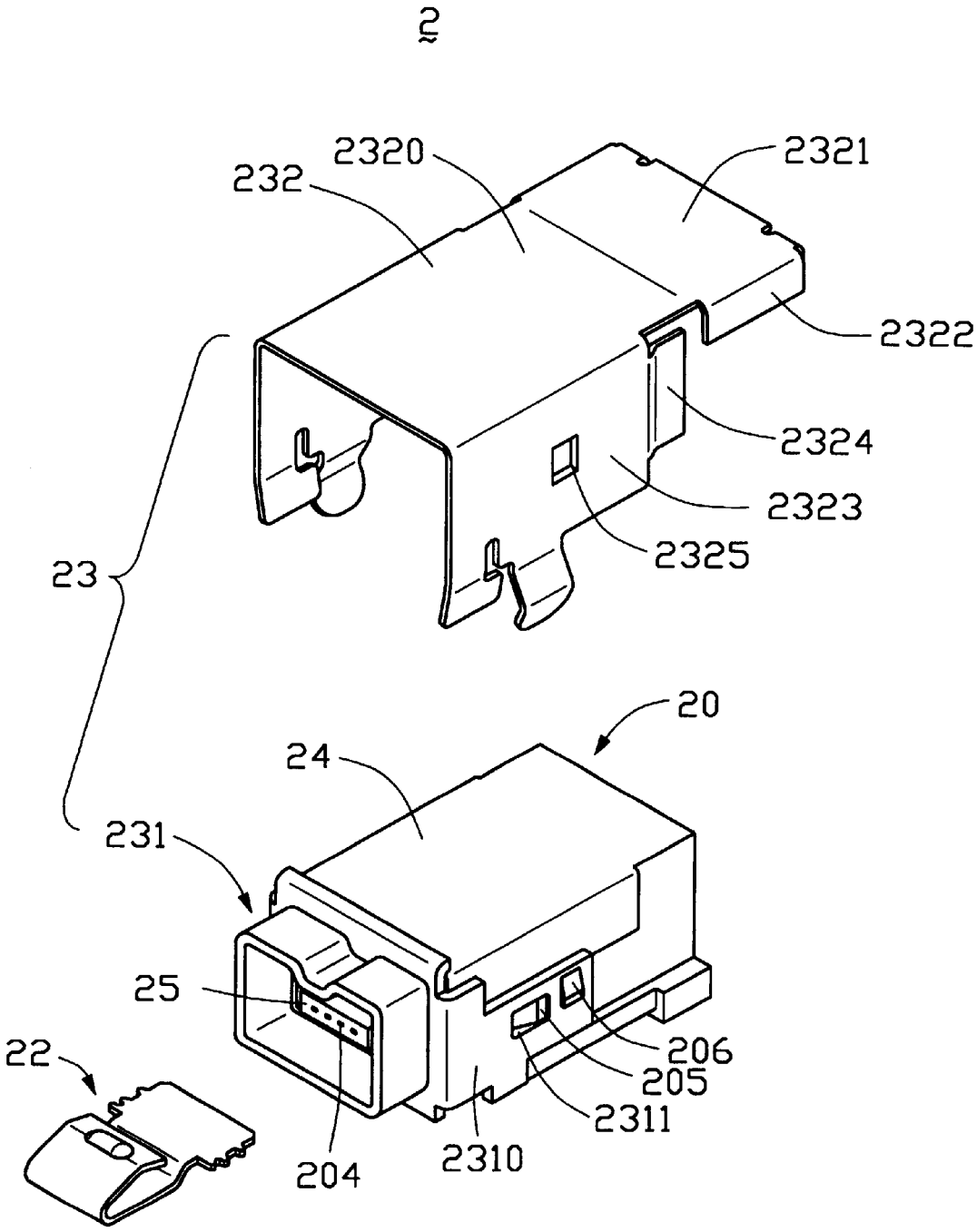
FIG. 1 is a partially exploded view of an electrical connector in accordance with the present invention, wherein a plurality of electrical terminals and a front shield are assembled to an insulative housing of the electrical connector.
Figure 2:
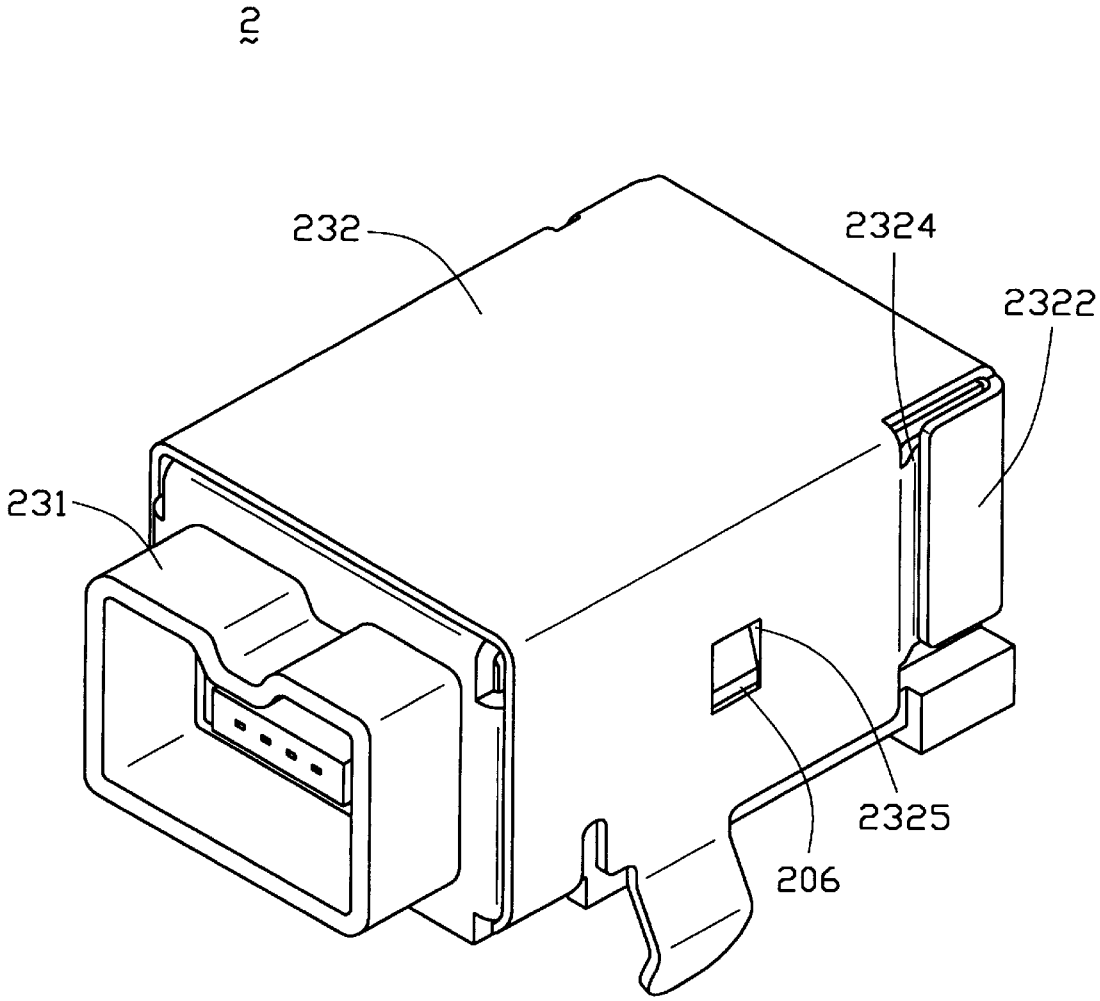
FIG. 2 is an assembled perspective view of the electrical connector of FIG. 1.
Figure 3:
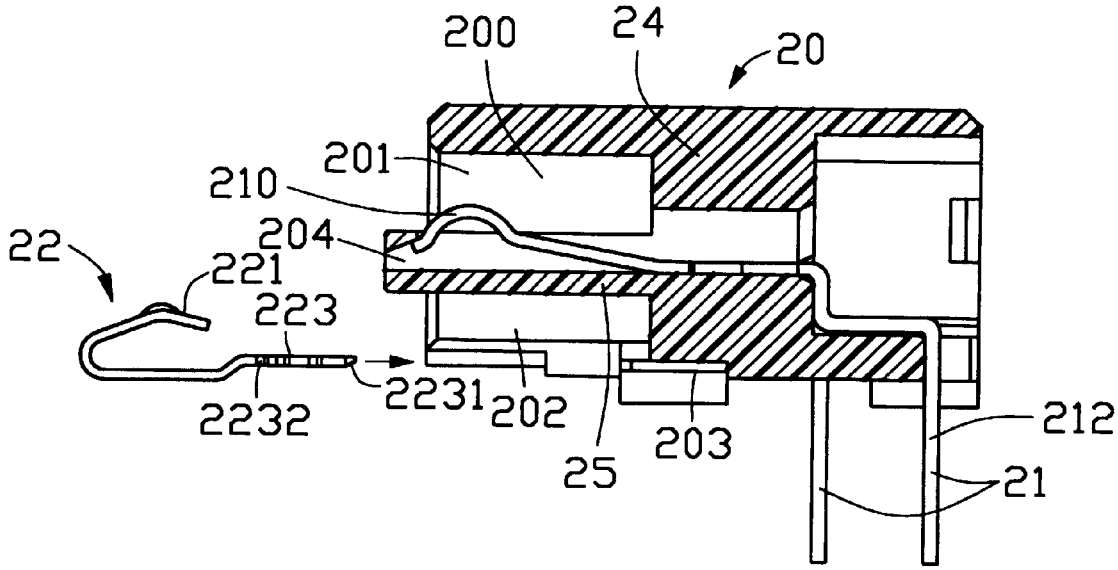
FIG. 3 is a cross sectional view of FIG. 2, wherein only the insulative housing and the electrical terminals are shown with the retention element being not inserted into the insulative housing.
Figure 4:
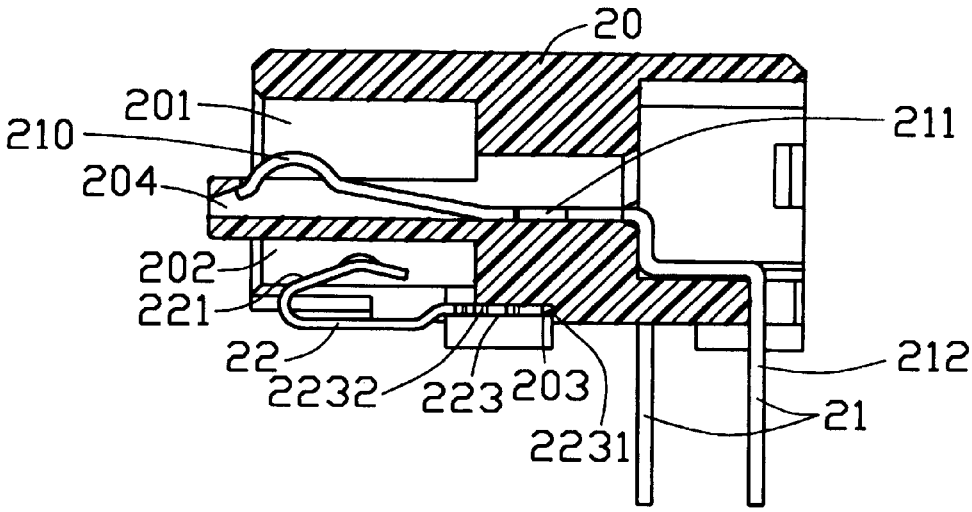
FIG. 4 is similar to FIG. 3, but the retention element has been assembled to the insulative housing.

Referring to FIGS. 1–4, an electrical connector 2 in accordance with the present invention comprises an insulative housing 20, a plurality of electrical terminals 21, a conductive shield 23 and a retention element 22.

The insulative housing 20 comprises a base portion 24 and an island portion 25. The base portion 24 defines a receiving cavity 200, generally rectangular in shape and open to a front side (not labeled) of the base portion 24. The base portion 24 further defines a horizontal slit 203 open toward the front side of and located at a bottom of the base portion 24. The island portion 25 extends forwardly from a rear wall (not labeled) of the receiving cavity 200 and through the receiving cavity 200, substantially dividing the receiving cavity 200 into a first portion 201 and a second portion 202. The first portion 201 and the second portion 202 communicate with each other at the sides of the island portion 25. The slit 203 communicates with the second portion 202. The island portion 25 extends substantially beyond the front side of the base portion 24. The island portion 25 defines a plurality of terminal passageways 204 in an upper surface (not labeled) thereof in communication with the first portion 201 of the receiving cavity 200. The terminal passageways 204 extend rearward through the base portion 24 and communicate with a bottom face (not labeled) of the base portion 24. The base portion 24 further forms a pair of protrusions 205 (only one shown) on opposite outer side surfaces (only one shown) thereof.

The electrical terminals 21 each comprise a curved contacting portion 210, a fixing portion 211 extending rearwardly from the contacting portion 210 and a mounting portion 212 extending rearwardly and downwardly from the fixing portion 211.

The conductive shield 23 comprises a front shield 231 and a rear shield 232. The front shield 231 defines an opening 2311 in each of two opposite side sheets 2310 (only one shown) thereof and forms a barb 206 adjacent to each opening 2311. The rear shield 232 comprises a top plate 2320, a pair of side plates 2323 and a rear plate 2321 bendably extending from a rear edge of the top plate 2320. The side plates 2323 each define a hole 2325 therein and form an extension 2324 extending rearwardly from a rear edge thereof. The rear plate 2321 comprises a pair of flanges 2322 bent perpendicular to a main body (not labeled) of the rear plate 2321 and corresponding to the extensions 2324 of the side plates 2323.

Figure 5:
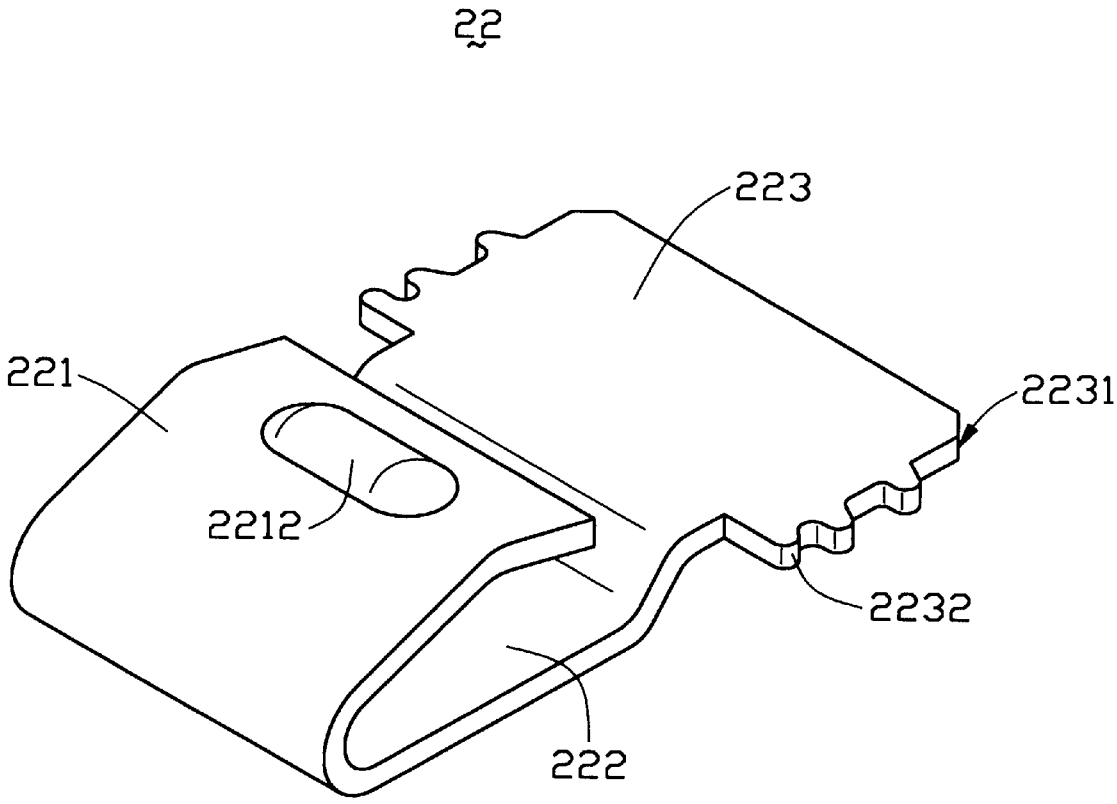
FIG. 5 is a perspective view of a retention element of the electrical connector of FIG. 1.
Figure 6:
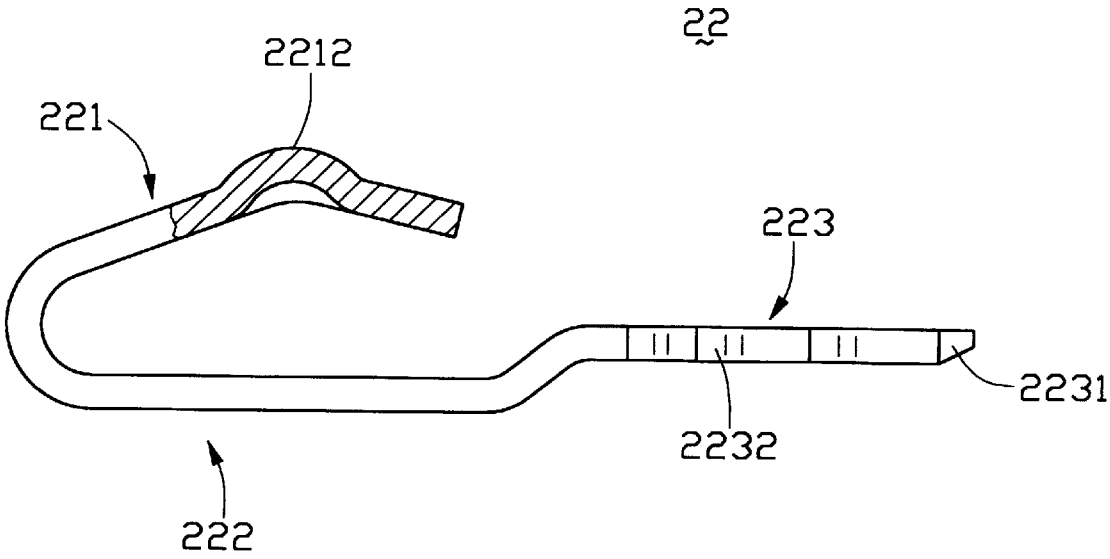
FIG. 6 is a side elevational and partially cross-sectional view of FIG. 5.
Figure 7:
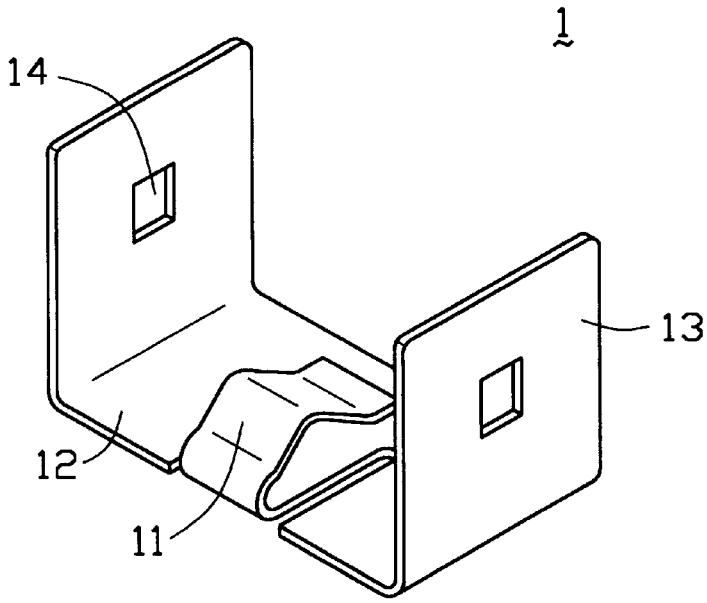
FIG. 7 (PRIOR ART)
FIG. 7 is a perspective view of a conventional retention element.
Figure 8:
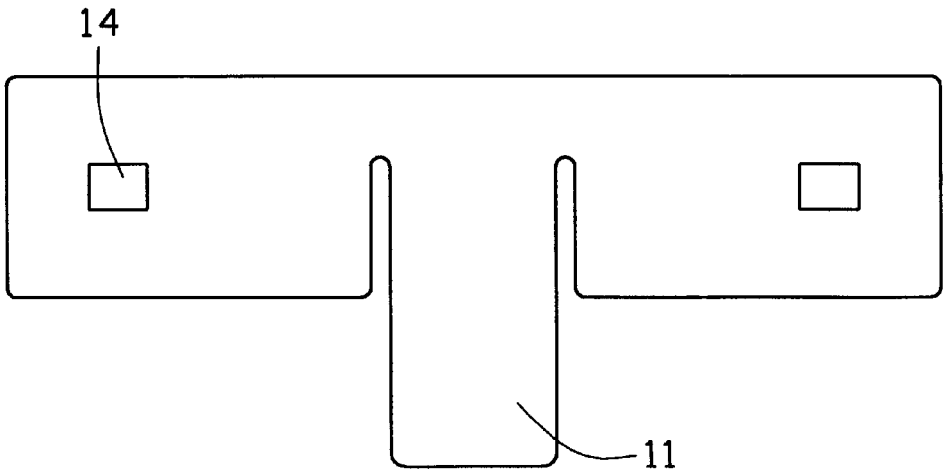
FIG. 8 (PRIOR ART)
FIG. 8 is a plan view of the retention element of FIG. 7 prior to bending.

Referring also to FIGS. 5 and 6, the retention element 22 comprises a curved portion 221, a transition portion 222 and a retention portion 223. The retention portion 223 defines a pair of opposite guiding faces 2231 on a rear edge thereof and forms a plurality of tabs 2232 on opposite side edges (not labeled) thereof The transition portion 222 extends downwardly and forwardly from a front edge of the retention portion 223. The curved portion 221 extends upwardly and rearwardly from a front edge of the transition portion 222 to be substantially parallel to the transition portion 222. The curved portion 221 forms an upwardly projecting embossment 2212 adjacent to a distal edge thereof.

In assembly, the electrical terminals 21 are inserted into the terminal passageways 204 of the insulative housing 20. The curved contacting portions 210 of the electrical terminals 21 protrude into the first portion 201 of the receiving cavity 200. The fixing portions 211 are fixed in the base portion 24 of the insulative housing 20 and the mounting portions 212 depend downwardly beyond the insulative housing 20 to be mounted to a printed circuit board (not shown). The retention portion 223 of the retention element 22 is inserted through the second portion 202 of the receiving cavity 200 into the slit 203 with the tabs 2232 thereof interferentially engaging with the insulative housing 20. The curved portion 221 extends in a direction parallel to a direction along which a complementary electrical connector (not shown) is inserted into the receiving cavity 200 and is substantially below a bottom of the island portion 25. The front shield 231 encloses a front side of the insulative housing 20 with the openings 2311 thereof engaging with the protrusions 205 of the insulative housing 20. The rear shield 232 encloses a rear portion of the insulative housing 20 with the holes 2325 engaging with the barbs 206 of the front shield 231 and the rear plate 2321 being downwardly bent, so that the flanges 2322 of the rear plate 2321 substantially overlap the extensions 2324 of the side plates 2323.

In use, when the complementary electrical connector is inserted into the receiving cavity 200 of the electrical connector 2, the curved portion 221 of the retention element 22 with the embossment 2212 resiliently engages with the complementary connector. The retention element 22 is simpler and more compact than that of the prior art and it is also more reliably retained in the insulative housing 20. Therefore, its cost is less and it functions better than the prior art retention element.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a base portion and an island portion, the base portion defining a receiving cavity and a slit therein, the island portion extending through the receiving cavity to substantially divide the receiving cavity into a first portion and a second portion in communication with the first portion and the slit;

a plurality of electrical terminals received in the insulative housing and partially protruding into the first portion of the receiving cavity; and a retention element assembled in the insulative housing, the retention element comprising a retention portion which is received in the slit of the base portion, a transition portion extending forwardly from the retention portion and a curved portion extending upwardly and rearwardly from the transition portion to project into the second portion of the receiving cavity and to be substantially parallel to the transition portion; wherein the retention element forms a plurality of tabs thereon for engaging with the base portion of the insulative housing; wherein the curved portion of the retention element forms an upwardly projecting embossment thereon.

2. The electrical connector as claimed in claim 1 further comprising a conductive shield enclosing the insulative housing.

3. The electrical connector as claimed in claim 2, wherein the conductive shield comprises a front shield assembled to the insulative housing and a rear shield assembled to the front shield and the insulative housing.

* * * * *